US007076823B2

(12) United States Patent
Downey

(10) Patent No.: US 7,076,823 B2
(45) Date of Patent: Jul. 18, 2006

(54) CONVENTIONAL BEDDING MATTRESS WITH ILLUMINATION PROPERTIES

(76) Inventor: Eric Downey, 4128 N. Clarendon, Chicago, IL (US) 60613

( * ) Notice: Subject to any disclaimer, the term of this patent is extended or adjusted under 35 U.S.C. 154(b) by 15 days.

(21) Appl. No.: 10/763,609

(22) Filed: Jan. 23, 2004

(65) Prior Publication Data

US 2005/0160535 A1 Jul. 28, 2005

(51) Int. Cl.
*A47C 31/00* (2006.01)

(52) U.S. Cl. ..... 5/716; 5/710; 5/905

(58) Field of Classification Search ..... 5/666, 5/716, 710, 905, 952; 362/30
See application file for complete search history.

(56) References Cited

U.S. PATENT DOCUMENTS

| | | | | |
|---|---|---|---|---|
| 3,818,521 A | * | 6/1974 | Richards, Jr. | 5/698 |
| 4,220,984 A | | 9/1980 | Truher et al. | 362/130 |
| 4,742,437 A | | 5/1988 | Downey | 362/130 |
| 4,788,731 A | * | 12/1988 | Yokoi et al. | 5/721 |
| 4,802,066 A | | 1/1989 | Mori | 362/32 |
| 5,605,393 A | | 2/1997 | Cucchi et al. | 362/97 |
| 5,683,169 A | | 11/1997 | Lucas et al. | 362/130 |
| 6,234,642 B1 | | 5/2001 | Bokamper | 362/130 |

FOREIGN PATENT DOCUMENTS

GB 000772025 * 4/1957

* cited by examiner

*Primary Examiner*—Patricia L. Engle
*Assistant Examiner*—Fredrick Conley
(74) *Attorney, Agent, or Firm*—Thomas J. Schab

(57) ABSTRACT

A conventional bedding mattress is constructed in a manner that permits light to permeate upwardly throughout the bedding components so as to illuminate the entire bed structure when a light source is placed below the mattress proper. The illuminating feature of the bed is accomplished by forming a bed mattress of a spring core section, a translucent netting layer disposed over the spring core, a unique foam padding that freely lays on top of the netting layer, and a material cover that envelopes the core and padding. The cover is provided with a clear plastic bottom portion sewn into the cover. The padding layer is translucent and this same padding is used as a padding layer within the cover. Light freely passes through the plastic of the cover, through the spring cores, then passing through the padding layer and into the cover, thereby illuminating the mattress upon provision of an underlying light source.

7 Claims, 3 Drawing Sheets

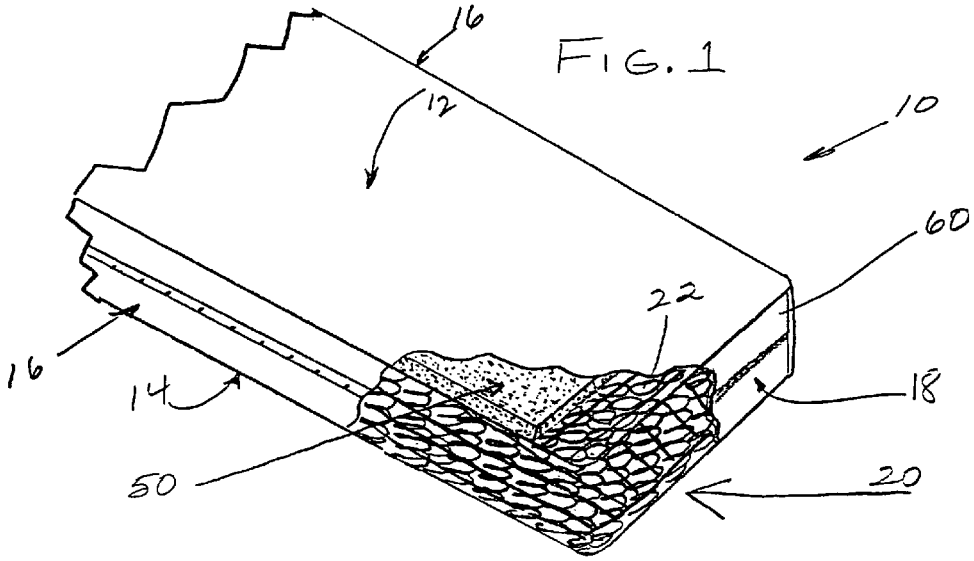
FIG. 1
FIG. 2
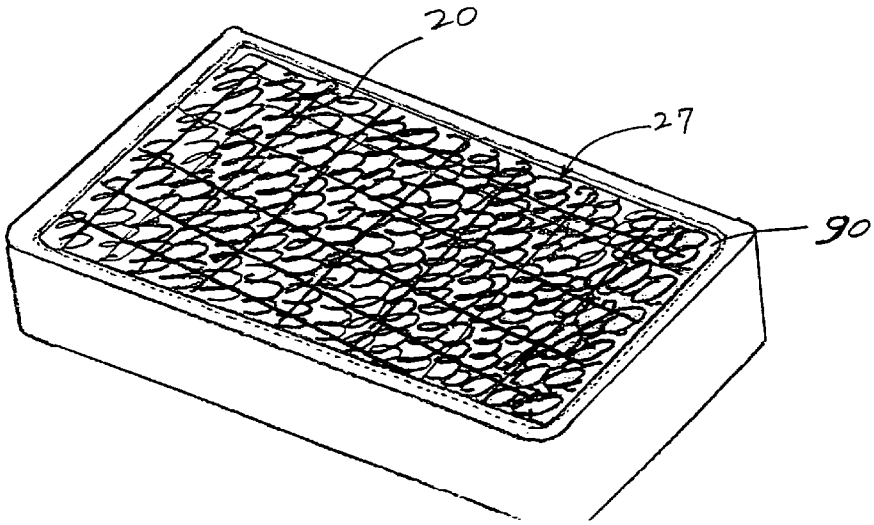

FIG. 5
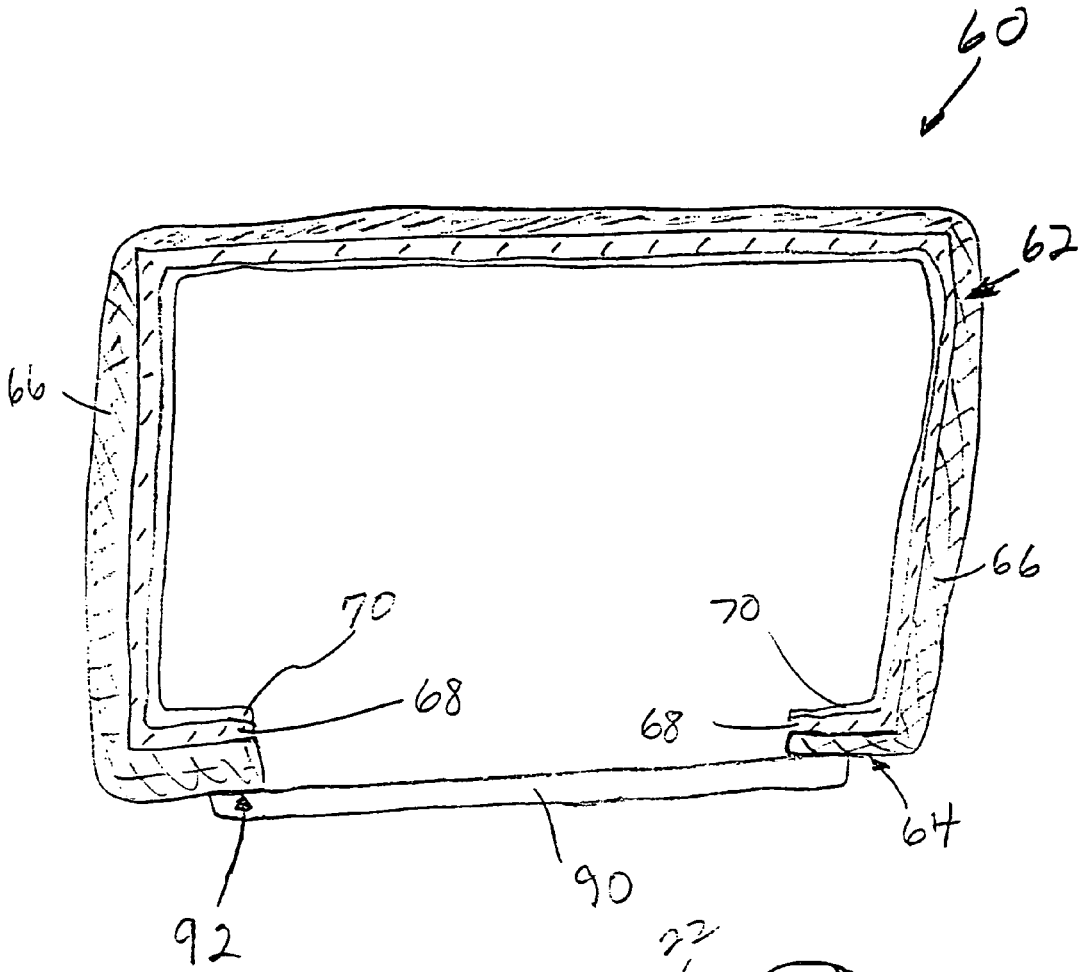
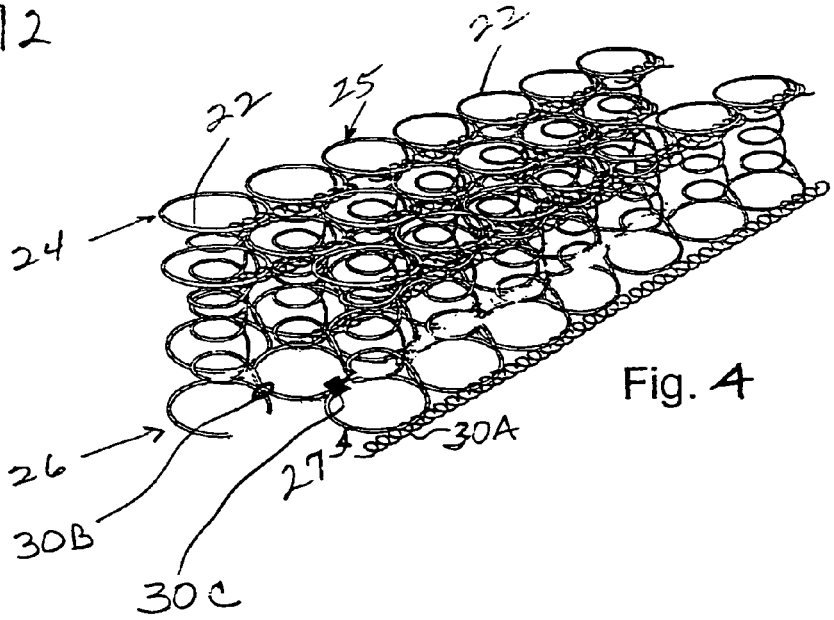
Fig. 4

CONVENTIONAL BEDDING MATTRESS WITH ILLUMINATION PROPERTIES

BACKGROUND OF THE INVENTION

1. Field of the Invention

The present invention relates to a conventional bedding mattress that is constructed with an inner core of springs, a translucent padding layer, and a mattress cover that comprises a transparent vinyl bottom panel attached to a top portion that also contains translucent padding materials. Collectively, this unique combination of translucent materials provides the mattress with illumination properties, whereby when an underlying source of light is placed below the mattress, the entire mattress, including the cover, becomes illuminated in a decorative manner.

2. Discussion of the Prior Art

Furniture designers constantly strive to provide new and aesthetically pleasing designs. In this regard, decoratively and/or functionally illuminating all types of furniture and bedding products with external and/or internal lighting sources has been desirous and popular of furniture and bedding manufacturers for years. Therefore, it is well known that many prior art devices, including furniture and bedding, have included external and/or internal lighting sources to either improve the product appearance or to change its functional properties. For example, in U.S. Pat. No. 3,099,398, a lighting mechanism was incorporated internally into a combination tool box and stand as a means to improve its utility. In U.S. Pat. No. 3,908,598, a transparent aquarium is disclosed having a single, extended fluorescent bulb extending across the top wall thereof as a means to improve the light dispersion throughout the transparent enclosure. U.S. Pat. No. 4,951,181 discloses various types of furniture employing the use of light diffusing glass blocks with an interior light source to provide a unique illuminated effect. A table having a light emitting top is disclosed in U.S. Pat. No. 5,605,393. Incorporating the use of lights in bedding furniture has also been very popular. For example, in U.S. Pat. No. 2,290,866, a lighting fixture is provided at the foot end of an ordinary bed on the underside, not to illuminate the mattress, but to provide indirect, low-level lighting of the floor area directly under and alongside the bed, thereby performing a night light function. In U.S. Pat. No. 4,220,984, an illumination device is secured to the underside head end of a water bed to increase the aesthetic pleasure of sleeping on a waterbed. In U.S. Pat. No. 4,742,437, issued to the present inventor, an improved water bed illumination system is disclosed whereby the waterbed frame incorporates an internal light source that upwardly illuminates light through bore holes in the membrane supporting wall, as well as through ports incorporated into the side rails of the frame. The end result is an illuminated water bed membrane and side frame that is very aesthetically pleasing and unique. In U.S. Pat. No. 4,802,066 a unique type of sun bathing bed made from a transparent cloth for supporting the user, incorporates a series of ultraviolet lights on the underside of the cloth to allow a user to enjoy a sweat-free, sun tanning experience. Other prior art disclosures in the bedding field were designed to improve the functionality of the bed, such as U.S. Pat. No. 5,683,169, which teaches the incorporation of fluorescent lights at the tops of the four bed post, or U.S. Pat. No. 6,234,642, which discloses a hospital bed that incorporates a weight-detecting sensor within the mattress to automatically turn on an underside nightlight.

Heretofore, none of the prior art disclosures address the concept of trying to illuminate a conventional bedding mattress because one of the greatest limitations associated with such mattresses is that the components comprising the mattress are not transparent. Therefore, they do not lend themselves to being illuminated by a light source like a water bed bladder membrane, which is generally made from a transparent, elastomeric material.

With that in mind, it would be ideal to overcome the shortfalls mentioned above by providing a unique conventional bed mattress construction and method for manufacturing the same, whereby a light source provided on the underside of the bed would illuminate upwardly through each of the components comprising the mattress so that an illuminated and aesthetically pleasing conventional mattress is accomplished.

SUMMARY OF THE INVENTION

It is the primary object of the present invention to provide a conventional bedding mattress with illumination properties. The object is met in the present invention with a conventional mattress comprising an inner core formed of a plurality of identical, interconnected coil springs, a translucent layer of elastomeric netting superimposed over a top end of said inner core so as to enclose said top ends of said coil springs, an unsecured, translucent padding layer superimposed over said elastomeric netting layer, and a covering for enclosing said padding layer and said core of springs. The covering is comprised of a top and a bottom panel, wherein said bottom panel is a clear vinyl material and the top panel is a fabric. The top part of said covering is enveloped about said top and sides of said core and the bottom part is disposed over said bottom side of said core. The top part of said covering is comprised of three component layers, said outermost component layer is a fabric material, said intermediate component layer is a second padding layer of the same material as the unsecured padding layer and said bottom component layer is a ticking material. One of the unique features of the mattress of the invention is that the padding layer is comprised of compressed polyester, as the intermediate component layer of the cover. The compressed polyester fill material is translucent to light, unlike conventional foam padding that is used in almost every mattress sold today.

The present invention further comprises a method of constructing a conventional bedding mattress having illumination properties. That method comprises the steps of providing a core of interconnected coil springs, securing a netting layer on said top of said core, placing a translucent padding layer on top of said netting layer, and then enveloping a covering about said core, netting layer and padding layer, wherein said covering contains a translucent padding therein.

The features and advantages of the invention will be further understood upon consideration of the following detailed description of an embodiment of the invention taken in conjunction with the drawings, in which:

BRIEF DESCRIPTION OF THE DRAWINGS

FIG. 1 is a perspective view of a fragment of the conventional mattress having illumination properties in accordance with the present invention.

FIG. 2 is an perspective view of the bottom of the mattress of FIG. 1 in accordance with the invention.

FIG. 4 is a perspective view of a part of the spring core portion of the mattress of the invention.

FIG. 5 is an exploded perspective view of the top panel of the cover layer of the mattress of the invention.

DETAILED DESCRIPTION OF A PREFERRED EMBODIMENT

Figure 3:
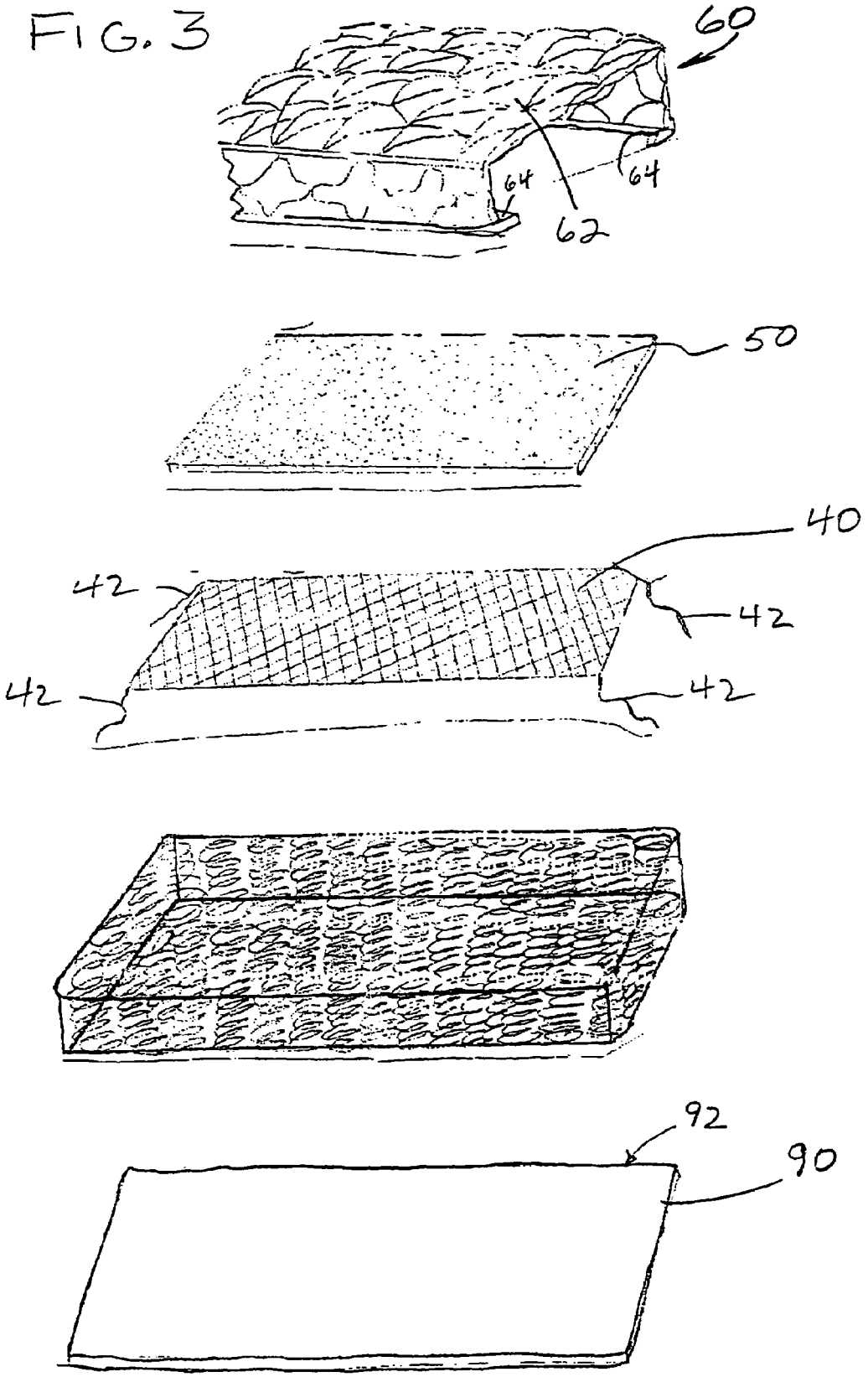
FIG. 3 is an exploded view of the mattress in accordance with the invention detailing the components comprising the mattress.

The invention provides exemplary illuminated mattresses and methods for their construction. FIGS. 1–3 show the conventional mattress 10 in accordance with the invention, said mattress having a generally rectangular configuration that is defined by a top 12, a bottom 14, and two identical long sides 16 and two identical short sides 18. The mattress with illuminating properties is constructed to have a generally rectangular inner core 20 that is comprised of a series of identical coil springs 22 that are interconnected by means of securing elements 30. Each of the coil springs 22 has a top turn 24 which corresponds to a top end, and a bottom turn 26 which corresponds to a bottom end 28. It is preferable to use coil springs where the top and bottom end turns of each spring are relatively larger in diameter than the intermediate turns, although a coil spring in which all of the turns are of the same diameter can also be used. The coil springs 22 preferably have at least two intermediate turns, but it is possible that they have at least one additional turn. Regardless of the type of coil spring that is being employed, it is preferable that the top and bottom turns 24,26, be flat wound. With flat wound turns, this means that the top and bottom end surfaces 25,27, will be planar, with the plane extending perpendicular to the center axis of each spring.

As best seen in FIG. 4, the securing elements 30 are attached to and between two like turns of adjacent springs. In one embodiment, which is the preferred method of interconnection, the securing elements may comprise extended coil springs, identified as element 30A, that are wound in between the turns of the springs 22. With this type of securing element, each turn of the extended coil spring is of the same diameter. When that securing elements 30A are incorporated, it is preferable that the coil springs 22 be interconnected through the top and bottom turns 24, 26. However, when using securing elements 30A, it is also possible to interconnect springs 22 through any of the same intermediate turns. Alternatively, the securing elements may comprise hog rings 30B or clips 30C, that interconnect only the top and bottom turns of each coil spring 22 when the coil springs are of the type having larger top and bottom turns. By attaching the individual coil springs to each other, the core 20 will have stability and comfort. In yet another embodiment of the core 20, border rods 34 may also be employed along the sides 16 and 18, adjacent the top ends 24 and the bottom ends 26 in order to further stabilize the core 20 and hence the mattress 10. The border rods 34 may be slid through the insides of each turn of securing elements 30A, and fastened thereto by well-known rings or clips. Alternatively, if securing elements 30B or 30C are used, the border rods 34 may be attached with rings or clips directly to the coil springs 22.

According to the invention, a translucent layer of elastomeric netting 40 is superimposed over all of the top turns of inner core 20 so as to enclose said top ends of each coil spring 22, as illustrated best in FIG. 3. (This netting layer 40 would not readily be seen in FIG. 1 because of the complexity of showing a very thin netting layer in conjunction as an overlay with the springs 22, therefore, it was not included in FIG. 1, although it is an integral part of the invention.) Alternatively, the netting may extend downwardly to the very bottom turn of each of the springs 22, or it may only extend partially down, so that it falls somewhere between the top and bottom ends 24,26 of each spring 22. There are a plurality of spaced tabs 42 that are used for loosely securing the netting layer to the core 20. The tabs 42 may be constructed from the same elastomeric material as the netting, or it may be a fabric material that is glued, heat bonded or sewn to the edge of the netting at the appropriate location. The number of tabs 42 that are used are not critical to the invention, as long as the netting layer 40 remains in a secure position relative to the inner core 20. The layer of netting may be formed with any type of pattern to create the netting effect, such as diamonds, squares, rectangles, etc.

As FIGS. 1 and 3 clearly show, superimposed over the layer of netting 40 is an unsecured padding layer 50 comprised of a compressed polyester fill material, wherein said compressed polyester fill layer permits the individual, independent compression of the top ends 24 of the coil springs 22 relative to each other, thereby providing comfort to the user. The layer of netting 40 prevents the padding layer 50 from depressing within the interior openings of each of the coil springs 22, thereby providing stability to the padding layer. One of the unique features of the present invention is the use of the compressed polyester fill material. This type of material has cushioning properties very similar to other mattress padding materials such as a polyurethane or latex foam, rebond (a carpet padding material) or a visco-elastic or memory foam, yet unlike those other materials, it is translucent to all types of light. This translucency feature is one of the most important aspects to the present invention having illumination properties. Without use of this material, no conventional mattress can be illuminated from its interior to its exterior. This material has a trade name of Poly-fil®, manufactured by the Fairfield Corporation, of Danbury, Conn., and it is available in thicknesses between 1–6 inches. For purposes of the present invention, it is preferable to use at least a three inch thickness in order to ensure a construction and comfort level that is comparable to the best mattresses on the market.

Another important aspect of the present invention lies in the construction of the covering 60 which envelopes and encloses the padding layer 50, the netting layer 40, and the inner core 20. As should be appreciated when viewing FIG. 1, when inserted over the other internal components, cover 60 holds the coil springs 22 of core 20 together to prevent or substantially reduce their lateral movement, thereby providing mattress 10 with greater stability. As FIGS. 1 and 3 illustrate, covering 60 is comprised of two sections, a top panel 62 and a bottom panel 90 that are attached together. The bottom panel 90 is a pliable, clear vinyl material that is completely light translucent and which extends along the bottom of core 20, substantially within all of the sides 16 and 18, as best seen when viewing FIG. 2. The bottom panel 90 is not directly attached to the core 20, but rather is attached to the top panel 62 by sewing, gluing, or heat bonding. The peripheral edge 92 of panel 90 is preferably sewn to a corresponding peripheral edge 64 on top panel 62. By incorporating a vinyl bottom panel 90 on the underneath side of mattress 10, any light source placed underneath the mattress 10 will illuminate upwardly through the coil springs 22 and further on through the netting layer 40 and padding layer 50 to the top panel 62 of cover 60. Turning to FIG. 5, it is seen that top panel 62 is comprised of three component layers and it provides additional padding to the user and serves as the sleeping surface for mattress 10. The outermost component layer 66 is a quilted layer that is visible to the user with a visible pattern sewn therein. This outer layer 66 is constructed from typical materials that are used in the industry, such as nylon, Dacron, polyester, or a combination of these. The bottom component layer 70 is comprised of a loosely stitched material such as cotton or nylon and it is commonly known in the industry as ticking. Layer 70 is relatively thin compared to the layers 66 or 68 and may be optionally provided. The intermediate component layer 68 is a second padding layer that may be provided in the form of a continuous sheet of material or it may be in the form of loose fill. This layer is comprised of the same compressed polyester fillfillfiber material that was used to form padding layer 50. The three layers 66,68, and 70 are preferably connected by sewing them together to form the unitary top panel 62, with the sewing function leaving the decorative patterns in the outer layer material. Optionally, the top panel 62 may be comprised of only the layers 66 and 68. As seen in the drawing figures, the top panel extends downwardly along the sides of inner core 20 and actually wraps around the very bottom turn 26 of the array of coil springs 22. As mentioned above, the ends of top panel 62 are then attached to bottom panel 90. Because the intermediate component layer 68 is a translucent layer just like padding layer 50, any light source that is placed underneath mattress 10 will project upwardly first through the clear vinyl panel 64, then internally of mattress 10, through the core 20, netting layer 40, padding layer 50, and finally through the intermediate layer 68 to illuminate the very top layer 66. If the intermediate layer did not utilize the compressed polyester fillfillmaterial, the illumination effect of mattress 10 would not be accomplished. Therefore, it is just as critical to the illumination effect of the invention as are the clear vinyl bottom panel, and the translucent netting and padding layers, 40 and 50.

While the apparatus and methods described herein form a preferred embodiment of this invention, it will be understood that this invention is not so limited, and changes can be made without departing from the scope and spirit of this invention, which is defined in the appended claims.

I claim:

1. A conventional bedding mattress having illumination properties when a source of light is placed underneath the mattress, comprising:

an inner core comprising a plurality of identical, interconnected coil springs each having a top and a bottom end, which when interconnected together, form a unitary top, bottom and sides of said mattress;

a translucent layer of elastomeric netting superimposed over said top end of said inner core so as to enclose said top ends of said coil springs, said netting secured to said inner core;

an unsecured padding layer comprised of compressed polyester superimposed over said elastomeric netting layer, wherein said unsecured padding layer permits individual movement of the top ends of the coil springs relative to each other and wherein said padding layer is translucent; and a covering for enclosing said padding layer and said core of springs, said covering comprised of a top and a bottom panel, wherein said bottom panel is a clear vinyl material and said top panel is a fabric, said covering being translucent, wherein when said light source is placed underneath said mattress, light from said source illuminates upwardly through said mattress to illuminate said top panel of said covering.

2. The bedding mattress of claim 1, wherein said top part of said covering is enveloped about said top and sides of said core and said bottom part is disposed over said bottom side of said core.

3. The bedding mattress of claim 2, wherein said top part of said covering is comprised of three component layers, said outermost component layer is a fabric material, said intermediate component layer is a second padding layer of the same material as said unsecured padding layer and said bottom component layer is a ticking material.

4. The bedding mattress of claim 3, wherein said intermediate component layer is comprised of compressed polyester.

5. The bedding mattress of claim 1, wherein said netting layer includes a plurality of spaced tabs for securing said netting to said core.

6. The conventional mattress of claim 1, wherein said coil springs of said core are interconnected by securing elements attached to adjacent springs.

7. A method of constructing a conventional bedding mattress having illumination properties, comprising the steps of:

providing a core of interconnected coil springs, wherein said core has a top, a bottom, and sides;

securing a netting layer on said top of said core;

placing a translucent compressed polyester padding layer on top of said netting layer;

enveloping a covering about said core, netting layer and padding layer, wherein said covering is translucent, and comprised of a top and a bottom panel, said bottom panel is a clear vinyl material and said top panel is a fabric, wherein when a light source is placed underneath said mattress, said mattress is adapted such that light from said source illuminates upwardly through said mattress to illuminate said top panel of said covering.

* * * * *